US009752271B2

(12) United States Patent
Bazzinotti

(10) Patent No.: US 9,752,271 B2
(45) Date of Patent: Sep. 5, 2017

(54) LAUNDERING SYSTEMS INCORPORATING VISUAL DISPLAYS

(75) Inventor: Joseph Anthony Bazzinotti, Kingston, MA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/819,234

(22) PCT Filed: Aug. 2, 2011

(86) PCT No.: PCT/US2011/046185

§ 371 (c)(1),
(2), (4) Date: May 10, 2013

(87) PCT Pub. No.: WO2012/027072

PCT Pub. Date: Mar. 1, 2012

(65) Prior Publication Data

US 2014/0157673 A1 Jun. 12, 2014

Related U.S. Application Data

(60) Provisional application No. 61/377,744, filed on Aug. 27, 2010.

(51) Int. Cl.
*D06F 39/14* (2006.01)
*D06F 31/00* (2006.01)
(Continued)

(52) U.S. Cl.
CPC ..... *D06F 39/14* (2013.01); *D06F 31/00* (2013.01); *D06F 39/005* (2013.01); *D06F 29/00* (2013.01);
(Continued)

(58) Field of Classification Search
CPC ..... D06F 39/14; D06F 31/00; D06F 39/005; D06F 33/02; D06F 29/00; D06F 2210/00
(Continued)

(56) References Cited

U.S. PATENT DOCUMENTS 2,676,477 A * 4/1954 Smith ..... 68/196
4,675,828 A * 6/1987 Winston ..... 700/286
(Continued)

FOREIGN PATENT DOCUMENTS

CN 1922353 A 2/2007
DE 102007061522 A1 6/2009
(Continued)

OTHER PUBLICATIONS

Office Action issued Feb. 12, 2015 in CN Application No. 201180050697.8.

*Primary Examiner* — Gregory Strimbu
(74) *Attorney, Agent, or Firm* — Price Heneveld LLP

(57) ABSTRACT

A visual display unit for a laundering system including a cabinet unit (12) for housing laundering elements; an outer door assembly (42), which includes a handle element (48) and control and/or monitoring elements (60), an inner door assembly (44), which includes the visual display unit (90); and an electrical system (140) for the visual display unit. This combination of elements substantially prevents exposure of the visual display unit (90) to laundering-specific operating conditions, high temperature and elevated humidity conditions. The laundering system includes washers, dryers, and combination washer/dryer systems.

16 Claims, 7 Drawing Sheets

(51) Int. Cl.
*D06F 39/00* (2006.01)
*D06F 29/00* (2006.01)
*D06F 33/02* (2006.01)

(52) U.S. Cl.
CPC ..... *D06F 33/02* (2013.01); *D06F 2210/00* (2013.01); *Y10T 29/49826* (2015.01)

(58) Field of Classification Search
USPC ..... 68/196; 49/400, 401, 402
See application file for complete search history.

(56) References Cited

U.S. PATENT DOCUMENTS 5,355,627 A * 10/1994 Katz ..... 49/479.1
6,591,527 B2 * 7/2003 Park ..... 40/564
6,853,399 B1 * 2/2005 Gilman ..... H04N 5/64 348/61
6,865,848 B2 * 3/2005 Krimmel ..... 49/409
7,308,808 B2 * 12/2007 Hallman ..... 68/18 C
7,713,090 B2 * 5/2010 Kendall ..... F25D 23/028 439/628
7,866,190 B2 * 1/2011 Jeong ..... D06F 33/02 68/13 R
8,220,204 B2 * 7/2012 Lee ..... F25D 23/02 312/405
2005/0183470 A1 8/2005 Kim et al.
2007/0051012 A1 * 3/2007 Schoene ..... 34/603
2007/0180869 A1 8/2007 Geyer
2009/0121970 A1 * 5/2009 Ozbek ..... 345/4
2012/0036900 A1 * 2/2012 Hong ..... D06F 39/005 68/139

FOREIGN PATENT DOCUMENTS

EP 2107152 A1 10/2009
WO WO-2009/080422 A1 7/2009

* cited by examiner

LAUNDERING SYSTEMS INCORPORATING VISUAL DISPLAYS

PRIORITY

Priority is claimed to U.S. Provisional Patent Application Ser. No. 61/377,744, filed Aug. 27, 2010, and International Application No. PCT/US2011/046185, filed Aug. 2, 2011, the disclosures of which are incorporated herein by reference in their entirety.

BACKGROUND OF THE INVENTION

Field of the Invention

The field of the present invention relates to laundering systems that incorporate visual displays, and particularly laundering systems that incorporate visual displays units within hatch doors.

Background

Many laundromats and businesses that use conventional commercial laundering systems have limited streams of income. When a user deposits money into a coin-operated washer or dryer, often the sole stream of income is generated. Conventional laundering systems, however, may be converted to utilize valuable advertising space and generate multiple streams of income. By incorporating visual display units into one or more hatch doors of a laundering system—advertising space for a captive audience is created.

While some kitchen appliances, e.g. refrigerators, have incorporated visual displays into doors, these displays are often placed a significant distance away from the interior of the appliance. This positioning likely avoids the effects appliance-specific conditions may have on the visual display. As a result, these types of displays are often shrouded by multiple panels and connected to extensive wiring such that visual access to the interior of the appliance is not possible.

In addition, other types of appliances, such as hand dryers, are known to incorporate visual displays. To avoid exposure of the video display to excessive heat generated during hand-dryer operation, these displays are typically mounted above hot air generators. But to assure proper operation, these devices use fans to control and direct heat away from the visual display.

Because of the high heat and humidity conditions generated during the operation of laundering systems, mounting a visual display on or above a laundering system or significantly away from the interior of the system is impractical. While suitable for their intended purpose, these types of displays are more than likely not optimal for use in the laundering industry, which serves consumers who expect and prefer visual access to the interiors of laundering systems.

Thus, to meet the expectations and preferences of consumers of the laundering industry, as well as to generate additional revenue streams for owners of conventional laundering systems, there is a clear need for laundering systems that incorporate visual display units into hatch doors.

SUMMARY OF THE INVENTION

The present invention is directed toward laundering systems that incorporate visual display units into hatch doors. The laundering system includes a body or cabinet unit, housing laundering elements; an outer door assembly, including a handle element and control and monitoring elements; an inner door assembly, including a display assembly; and an electrical system for a visual display unit. This combination of elements substantially prevents exposure of the display unit to laundering-specific operating conditions, including exposure to water, as well as high temperature and elevated humidity conditions.

BRIEF DESCRIPTION OF THE DRAWINGS

The drawings described herein are for illustrative purposes only and are not intended to limit the scope of the present disclosure.

In the drawings.

DETAILED DESCRIPTION

Figure 1:
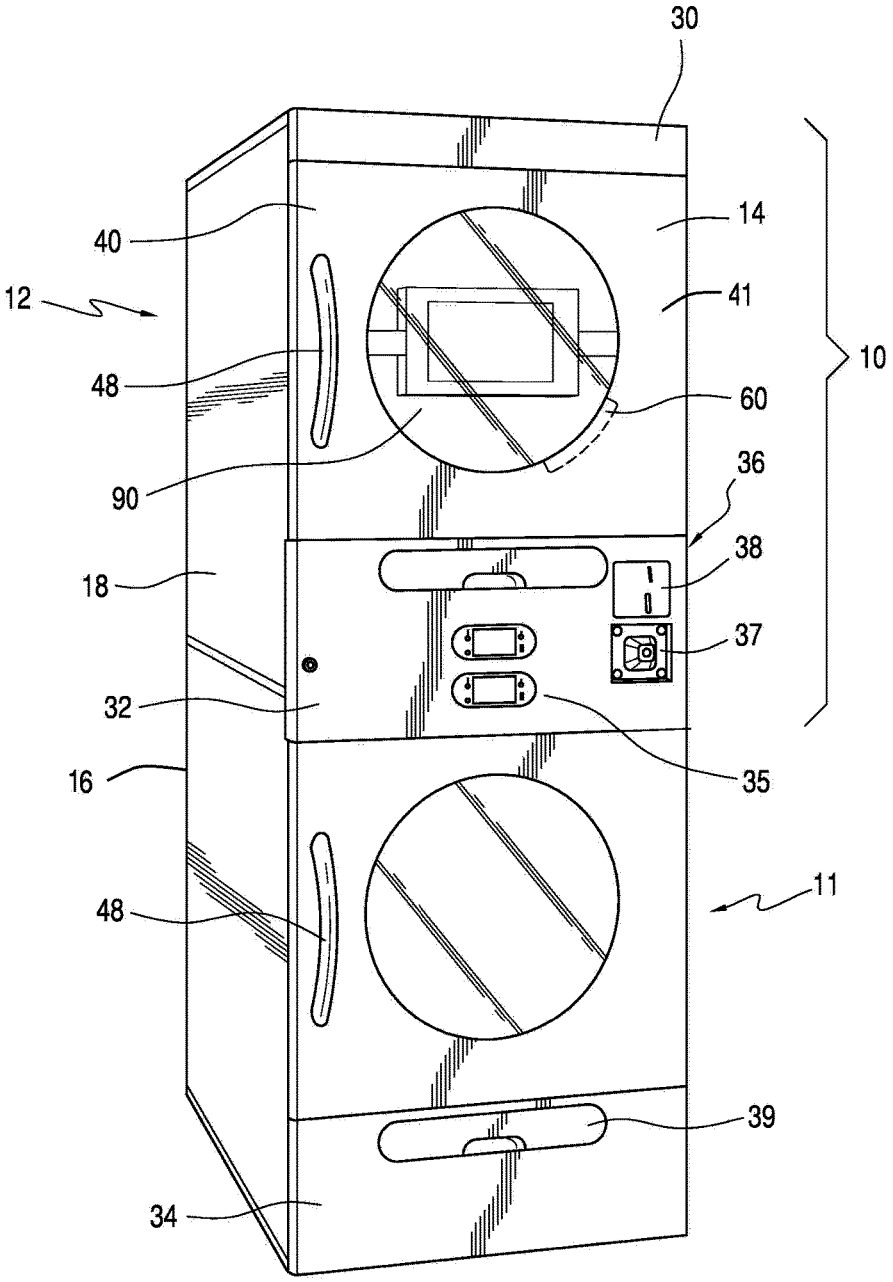
FIG. 1 is a perspective view of a laundering system, incorporating a display unit, mounted to a separate laundering system, without a display unit.

Turning in detail to the drawings, FIG. 1 illustrates a laundering system 10 that incorporates a visual display unit 90. The laundering system 10 may be a washer, a dryer, or a combination washer/dryer. The system 10 may be used for laundering fabric articles, for example. In addition, the laundering system 10 may be used for any material(s) suitable for washing and/or drying. The laundering system 10 may or may not be mounted to a separate laundering system 11 with or without a visual display unit.

Figure 2:
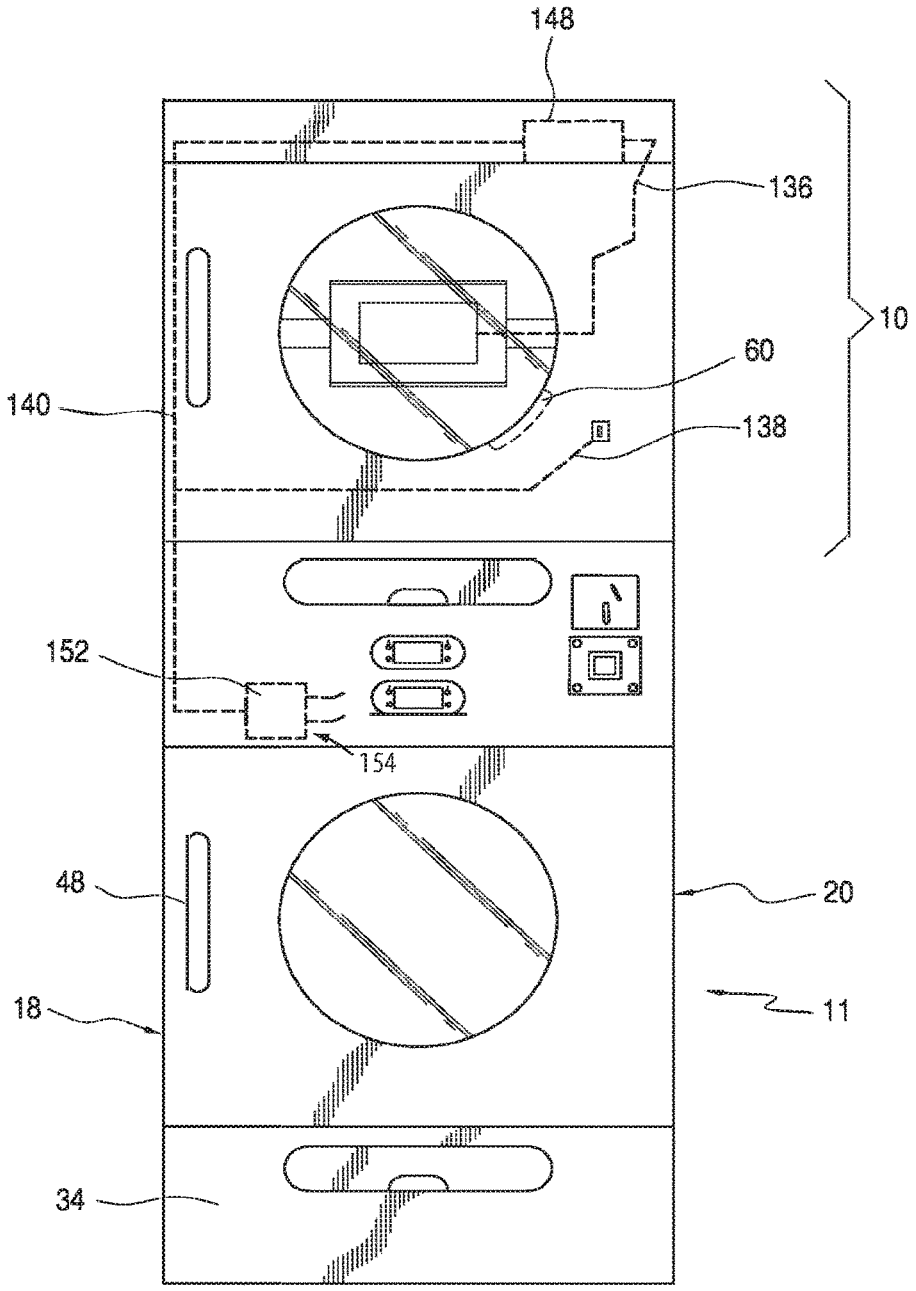
FIG. 2 is a front view of the laundering system shown in FIG. 1.

FIGS. 1 and 2, respectively, show perspective and front views of a laundering system 10, which is mounted to a separate laundering system 11 without a visual display unit. The system 10 includes a body or cabinet unit 12, having a front panel 14, a rear panel 16, and a pair of side panels 18, 20. When assembled, the cabinet 12 may form a substantially cuboidal shape. The shape of the cabinet, however, may vary, as a matter of design choice, through use of additional panels and/or other elements. In addition, the system 10 includes a laundering system door assembly 40, which includes a visual display unit 90, and an electrical system 140 (FIGS. 2, 6 and 7), as further described below.

Contained within the cabinet 12 are one or more chambers or drums used to house laundering articles, such as clothing and other fabric articles. Preferably, these chambers or drums are cylindrically shaped for mounting within the cabinet 12 and for rotation around a substantially horizontal axis. A motor is configured to rotate the chambers or drums.

Each chamber or drum also includes an opening configured to receive laundering articles for placement into the chamber or drum. If the laundering system 10 incorporates electric, steam, or gas dryer systems, the chamber or drum may include a plurality of apertures, which are configured to receive hot air that has been heated by heating elements incorporated within the laundering system.

In one configuration, the laundering system 10 includes an upper panel 30 and a middle panel 32. Optionally, a lower panel 34 may be positioned on the separate laundering system 11. Any of these panels 30, 32, 34 can have touch and/or dial controls 35 whereby a user can control and/or monitor laundering-specific operating conditions and display components within the system 10.

Preferably, within the middle panel 32 are one or more monetary collection areas 36 that can include a collection box 37 and a monetary receiver 38. The monetary receiver 38 may be configured to collect either coins, electronic debit, and/or bills. In addition, the middle and lower panels 32, 34 may optionally house one or more lint collection areas 39.

Figure 3:
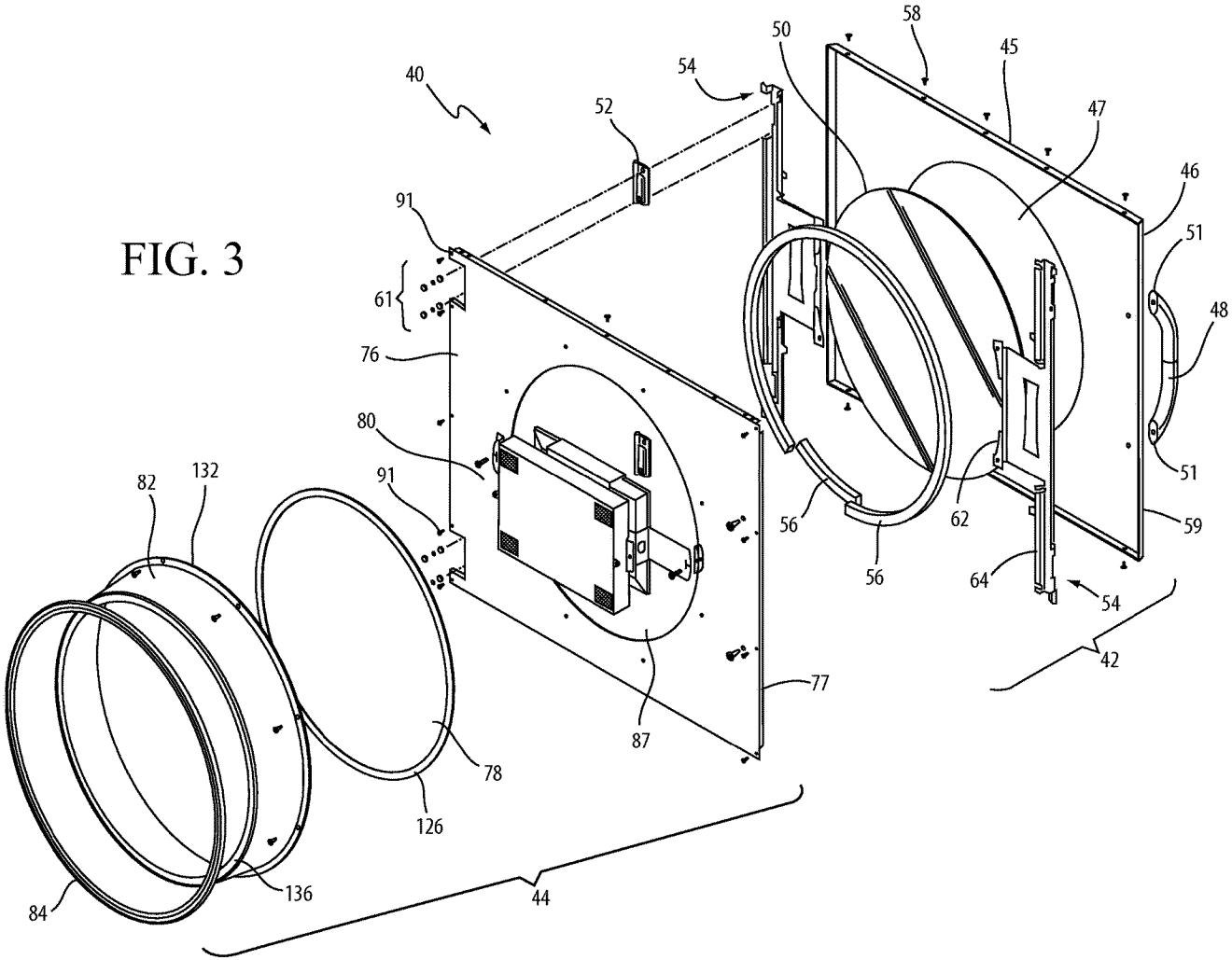
FIG. 3 is an exploded view of an outer door assembly and an inner door assembly.
Figure 4:
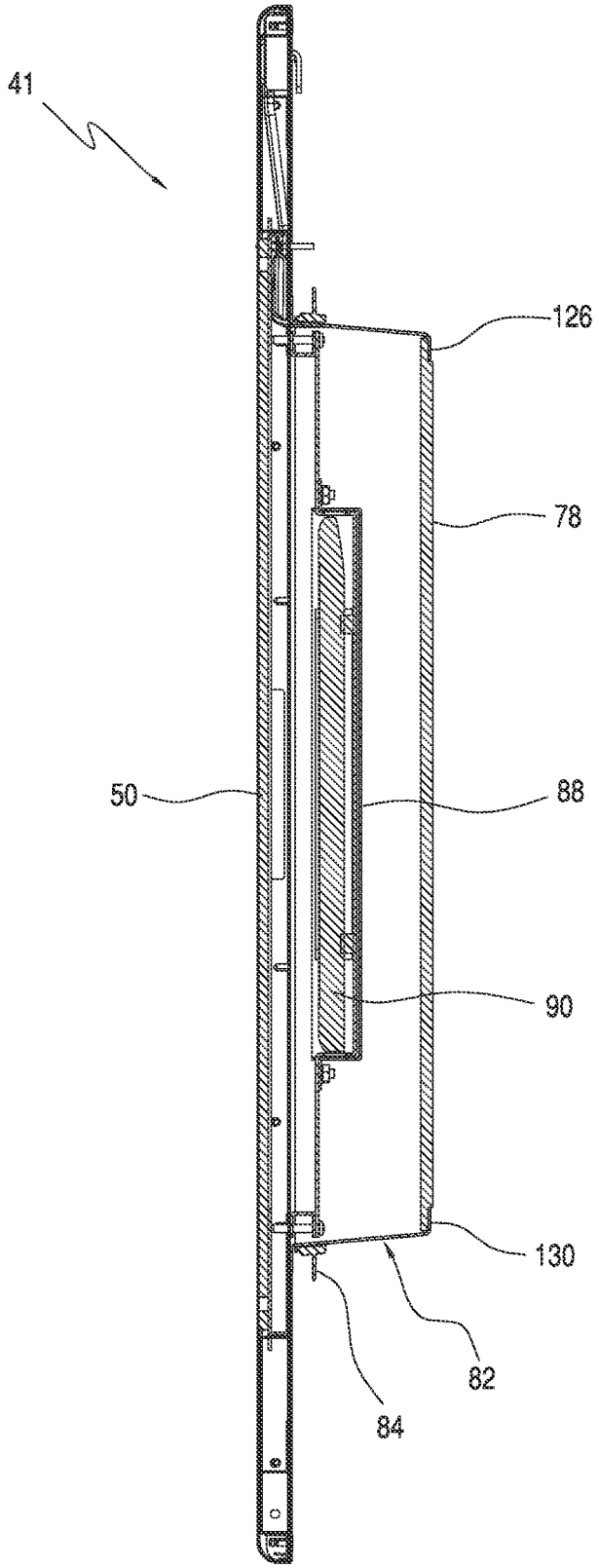
FIG. 4 is a cross-sectional view of one type of hatch door for a laundering system, which incorporates a visual display unit.

FIG. 3 shows an exploded view of a laundering system door assembly 40, which may be coupled to an opening to form a hatch door 41 (FIGS. 1-2, and 4). As used herein, a hatch door is broadly construed as a hinged, sliding, or lifting door, which is used to cover an opening in a cabinet. Although the hatch door 41 is preferably coupled to a front panel (FIGS. 1 and 2), the door may be coupled to any suitable opening on a face of the cabinet. In preferred configurations, the hatch door 41 is manufactured using at least two layers of sheet steel having stiffening elements positioned between the layers.

The laundering system door assembly 40 includes an outer door assembly 42 and an inner door assembly 44. The outer door assembly 42 includes an outer door skin 46, a handle element 48, an outer pane 50, one or more hinges 52, hinge brackets 54, and one or more outer gaskets 56. Optionally, one or more control and/or monitoring elements 60 may be included within the outer door assembly. In addition, various types of fastening elements 61, including, but not limited to screws, nuts, magnets, tapes, and adhesives may be used to couple various components of the outer door assembly 42.

In the configuration shown in FIG. 3, the outer door skin 46 has a substantially rectangular perimeter 45 and an outer opening 47, having a substantially circular shape. These shapes, however, are not to be construed as limiting and may be a matter of design choice. The outer door skin 46 includes hinge bracket connection areas 58 and bends 59 to facilitate attachment to other components of the outer door assembly 42.

Coupled to the outer door skin 46 is a handle element 48, shown having an arcuate shape. Although shown as a separate component, the handle element 48 may be incorporated into a face of the outer door skin 46. The handle element 48 is designed for easy gripping by a user and can have ends 51, which terminate for connection to the outer door skin 46. One or more handle elements 48 may also be coupled to the separate laundering system 11.

The outer door assembly 42 also includes an outer pane 50, which is preferably made from glass or other type of material(s), having sufficient transparency. This material should be suitable for laundering-specific temperatures and humidity conditions.

Where the laundering system is a gas, steam, or electric dryer, laundering-specific temperatures within the chamber or drum can range from about 70 degrees Fahrenheit (21° C.) to about 200 degrees Fahrenheit (93° C.). In addition, laundering-specific humidity measurements within the chamber or drum of gas, steam, or electric dryers range from about 20% to about 100%, condensing. Additional laundering-specific operating conditions include the relative transparency of the panes used within the door assembly and pressure measurements with system chambers or drums.

Where a visual display unit 90 is incorporated within a hatch door 41, other laundering-specific operating conditions include actual temperature of the display unit, which could be measured on the backside of the unit, for example, and the atmospheric temperature of the display unit. The atmospheric temperature of the display unit is defined herein as the temperature measured in an open area between two or more panes within about a one-inch to about a ten-inch radius of the perimeter of the display unit.

Figure 6:
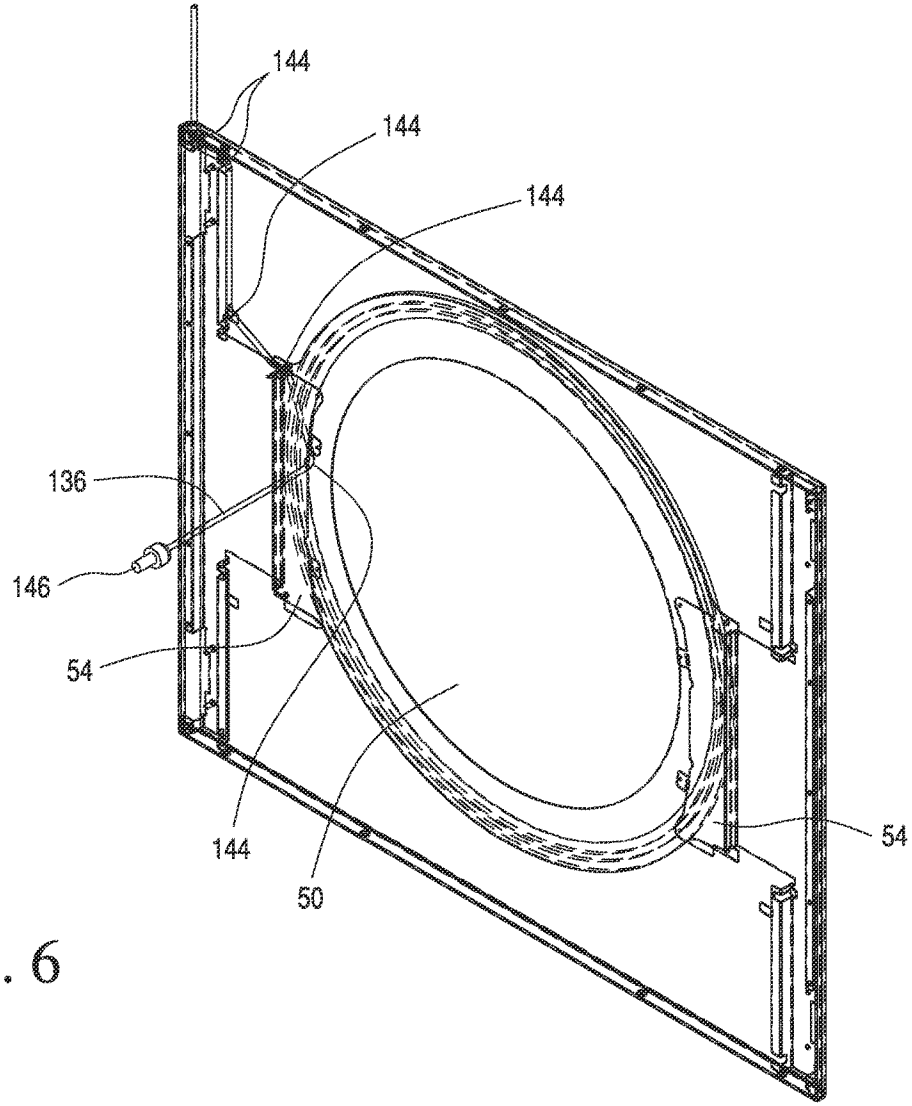
FIG. 6 is a partially assembled hatch door; showing the positioning of wiring or cable.

As further shown in FIGS. 3 and 6, the outer pane 50 preferably conforms to the shape of the outer opening 47 in the outer door skin and is held in place using one or more brackets 54. These brackets 54 have flanged inner portions 62 and outer portions 64 for coupling to the outer pane 50 and hinges 52. In addition, for flush positioning of the pane 50 against the outer door skin, one or more spacers may be used.

The laundering system 10 may also include one or more control and/or monitoring elements 60. In one embodiment, at least one monitoring element 60 is coupled to the front panel 14. These elements may be used to monitor temperature, humidity, and other laundering-specific operating conditions. The one or more control and/or monitoring elements 60 may further include connecting elements and sensors, which may be coupled to the display unit 90, temperature controls and/or humidity controls. In addition, these elements 60 preferably have any shape suitable for positioning within the door assembly 40 such that viewing of the system interior is not obstructed. Arcuate shapes, however, for these controls and monitoring elements are preferred. In one embodiment, a residual moisture control element, having a sensor, is coupled to the front panel.

For additional control of operating conditions, such as exposure to water and high temperatures, and increased levels of humidity, one or more gaskets 56 may be included within the outer door assembly 42. Any of the gaskets used herein may be manufactured from any material that improves operating conditions of the laundering system 10 and prevents exposure of the display unit 90 to water, as well as high temperature and elevated humidity conditions. Such gasket materials include, but are not limited to, polyurethane foam and various types of polymeric materials, including polymeric materials manufactured from urethane, e.g. Poron Urethane, and silicone.

FIG. 3 also shows the inner door assembly 44. This assembly includes an inner door skin 76, an inner pane 78, a display assembly 80, a door pan 82, and one or more door gaskets 84. The inner skin 76 has a substantially rectangular perimeter 77, and an inner opening 87, which is substantially circular. At least one side of the perimeter has hinge receiving areas 91. In the configuration shown, the hinge receiving areas 91 are adapted for placement of a hinge 52 that allows for the hatch door 41 to pivot about a substantially vertical axis. Preferably, the inner door skin 76 is manufactured from a metallic material (e.g. steel) and is suitable for use as a weldment.

Figure 5A:
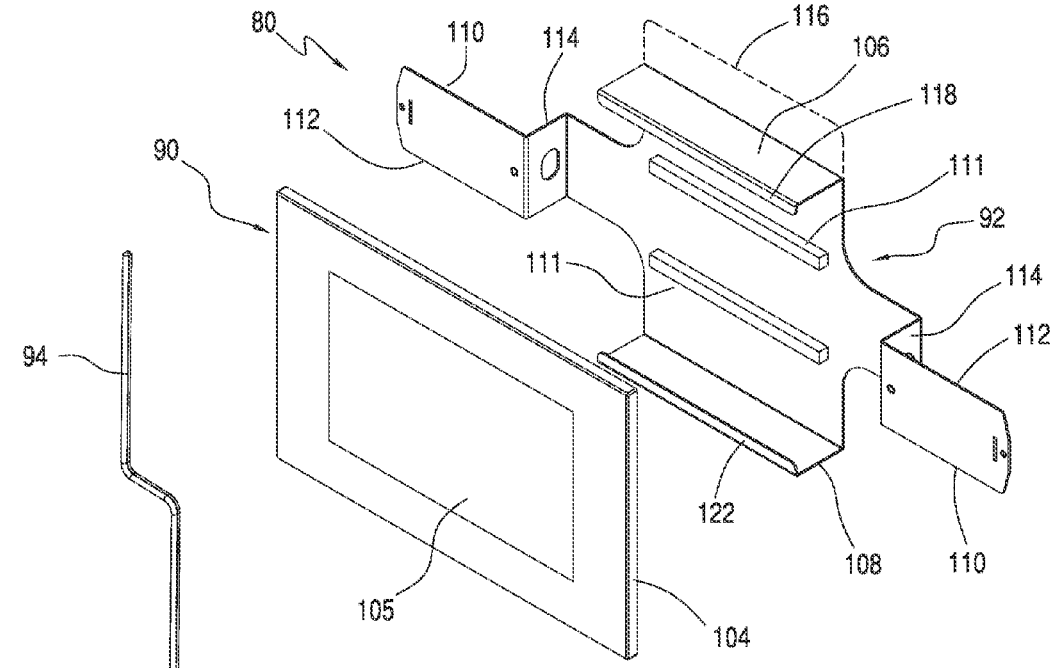
FIG. 5A is an exploded front perspective view of a partial display assembly, showing a visual display unit and a display mount bracket
Figure 5B:
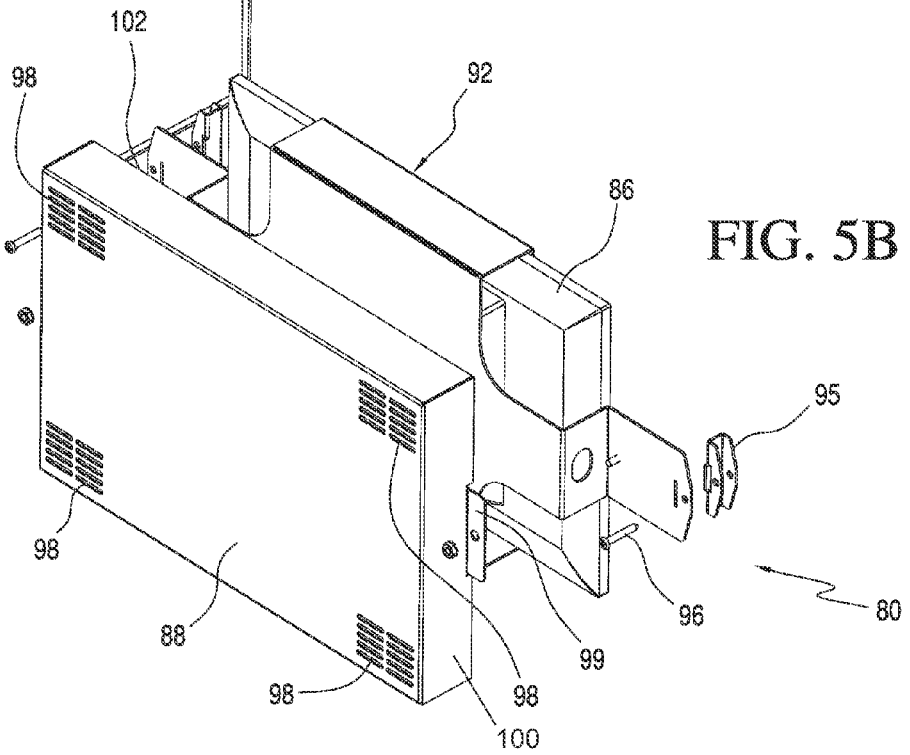
FIG. 5B is an exploded rear perspective view of another display assembly, showing a visual display unit, a display mount cover, a display mount bracket, and a door harness.

A display assembly 80 is configured for positioning, at least partially, within openings 47, 87. FIGS. 5A and 5B show exploded perspective views of the display assembly 80 that includes a display mount cover 88, a display unit 90, a display mount bracket 92, and an attachment mechanism 94 (FIG. 5B). Also, the assembly 80 may include one or more display spacers 95, display fastening elements 96, and cushioning elements 111 (FIG. 5A).

The display mount cover 88 (FIG. 5B) is configured to fit over the exterior 86 of the display unit 90. The cover includes venting elements 98 which are symmetrically positioned on the backside of the cover 88. In addition, the cover 88 has connection brackets 99, which may used to facilitate connection of the cover to other components within the system. In the configuration shown, the cover 88 has surrounding elements 100 that form a substantially rectangular perimeter and which define a cavity 102 for placement of the display unit 90.

As shown particularly in FIG. 5A, the display unit 90 preferably has a substantially rectangular perimeter 104 and a viewing area 105. In some embodiments, the display unit 90 has an 8-inch or 10-inch display area. Suitable display units include, but are not limited to, 8-inch and 10-inch digital media frames and tablets, having maximum operating temperatures ranging from about 80 degrees Fahrenheit (27° Celsius) to about 150 degrees Fahrenheit (66° Celsius). Display units are manufactured by Toshiba Corp., Acer, Apple, Archos, Arnova, Asus, Research in Motion, Boss Electronics, Coby, Creative Labs, Dell, E Fun, Foxcomm, Hewlett Packard, Huawei, HTC, iCan, Kaser, Lenovo, Motorola, Pandigital, Samsung, Tivax, Velocity, Viewsonic, and Vizio, among others. These devices are adapted to support various audio and media formats, including but not limited to MP3, MP4, WMA, JPEG, BMP, TIFF, GIF, MPEG-4, MPEG-2, and MPEG-1.

Some versions of display units incorporated within the laundering system also include remote controls, which can be used to access laundry control menus and display control menus. Interfaces for the display unit also include, but are not limited to Hi-Speed USB devices and other wired or wireless devices which meet national and international standards for visual displays. Such standards may include Institute of Electrical & Electronics Engineers ("IEEE") Standards, such as IEEE 802.11g and IEEE 802.11h.

Preferably, the display unit 90 is relatively light-weight such that opening the hatch door 41 is not cumbersome. Preferred display unit models include those that have a weight of less than 3 pounds (lbf). Two embodiments of the laundering system incorporate display units that are about 1.9 pounds and about 3 pounds (lbf).

The display unit 90 allows for the uploading of advertisements and other types of visual content via media interfaces. These interfaces are preferably coupled to wiring harnesses routed within channels disposed within the assembled hatch door 41. The display unit 90 can also have the ability of remotely accessing an array of service and maintenance videos, using protocols, for example.

Content shown on the display unit 90 can include, but is not limited to, advertisements, sales, service or safety information, gaming, and internet access. In addition, these units can also display various types of media, thereby providing access to service materials and training materials. This type of content can be particularly helpful in training new employees on laundromat premises, as well as training employees working in other types of commercial laundering facilities (e.g. hotels, hospitals, uniform rentals companies and professional launderers).

As shown particularly in FIGS. 5A and 5B, the display assembly 80 also includes display mount brackets 92, which may vary in size, depending on the dimensions of the display unit 90 and the size of the openings in the outer and inner door assemblies. This bracket is preferably manufactured from a bendable material such as sheet metal. In the configuration shown in FIG. 5A, the mount bracket 92 includes an upper restraint 106, a lower restraint 108, side restraints 110 and cushioning elements 111.

The side restraints 110 include extending portions 112, and side mount elements 114. The extensions portions 112 may vary in length, depending on the size of the openings in the outer and inner door assemblies. (Compare FIGS. 5A and 5B). The upper restraint 106 preferably is manufactured with a vertically extending portion 116 that is configured to bend after the display unit 90 is positioned. The front bend also has an upper restraining portion 118 that upon assembly extends partially on the front upper face of the display unit 90. The lower restraint 108 preferably is pre-bent to receive the display unit. However, this restraint does have a lower restraining portion 122 configured for positioning on the lower front face of the display unit.

In an alternate embodiment, the mounting bracket 92 is positioned in front of the display unit 90. At least two outer surfaces of the display unit are positioned within bends on the mounting bracket. Alternatively, the display unit is mounted to the bracket 92 with adhesives, which are suitable for use under laundering-specific operating conditions.

Also included on the display mount brackets 92 are cushioning elements 111. These elements 111 provide for cushioning of the display unit 90 upon assembly and also provide for open areas between the rear of the display unit and the mount bracket 92. This allows for ventilation of the display unit 90, further providing for temperature control within the system 10. These elements are preferably manufactured from elastomeric materials. In some embodiments, these elastomeric materials include Ethylene Propylene Diene Monomer (EPDM) materials and Nitrile. In the configuration shown in FIG. 5B, the cushioning elements 111 are elongated and have a rectangular cross-section. Fewer or more of the cushioning elements of various shapes and sizes, however, may be used. These elements are mounted to the display mount bracket 92 using an adhesive, e.g. double-coated tape, manufactured by the 3M, using 300MP 9832 adhesive.

Once assembled, the laundering system door assembly 40 also provides for channels within the assembled hatch door 41 for routing harnessing devices and wiring, as further described below. To this end, the display assembly may further include an attachment mechanism 94 that facilitates attachment of the display assembly within the latch door.

Referring to FIGS. 3 and 4, the inner door assembly 44 also includes an inner pane 78, a door pan 82 and one or more door gaskets 84. The inner pane 78 is positioned a predetermined distance behind the display assembly and is shaped to conform to the inner opening 87 of the inner door skin. The inner pane 78 is also preferably made from glass or another type of material, which has sufficient transparency, which allows for viewing of fabric articles contained within the drum. Moreover, the inner pane material preferably is suitable for high temperatures and elevated humidity conditions generated by laundering equipment. The inner pane 78 is provided with a recessed area 126 on its backside that allows for positioning with a lip area 130 on the door pan 82.

As shown in FIGS. 3 and 4, the door pan 82 has an outer rim 132 that is taped to mate with the inner pane and the inner door skin. A door gasket 84 is configured to mate with the outer surface of the door pan, thereby sealing any gap between the pan and the inner skin, after final assembly. FIG. 4 shows a cross-sectional view of one embodiment of an assembled door assembly 40, shown as a hatch door 41.

FIG. 2 shows the placement of an electrical system 140 within the hatch door 41 of a laundering system 10, represented using hidden lines. And, FIG. 6 shows the positioning of wiring or cable on a partially assembled hatch door 141. In one configuration, shown in FIG. 2, the electrical system 140 includes display wiring or cable 136, data wiring or cable 138, a power junction box 148, having a transformer 150 (FIG. 5), and an interface junction box 152. At an upper area of the hatch door 41, power wiring or cable and data wiring or cable 138 are routed into the power junction box 148. The power wiring/cable is used to provide power to the display unit. The data wiring or cable 136 is configured to pass through about 100 to about 240 vac power, using an opening in the front panel. From this position, the data wiring or cable extends below an upper chamber or drum.

FIG. 6 is a rear view of a partially assembly hatch door 141, showing one example of how display wiring or cable 136 may be positioned before the display unit is incorporated. In this example, the display wiring or cable 136 is coupled to a hinge bracket 54, using one or more connectors 144. These connectors preferably include tape materials and wire ties, having suitable properties for extended use with laundering systems and exposure to water and high temperature and humidity conditions. Some properties of the connectors may include corrosion resistance and adhesion characteristics. FIG. 2 also shows optional power and external memory connections 146 that facilitate connection to other interfaces within the laundering system 10.

The junction boxes 148, 152 (FIG. 2) preferably are located in easily accessed locations within the system 10. In one configuration, the power junction box 148 is positioned within a cavity located behind the upper panel 30 of the laundering system 10 and the interface junction box 152 is positioned within a cavity behind the middle panel 32. However, these boxes 148, 152 may be positioned within other areas of the laundering system 10.

The interface junction box 152 is configured to provide access to data from various sources, e.g. a computer. The interface junction box 152 includes an interface connection area 154 for installation of various types of memory devices. Although the junction box 152 may have a USB connector, the interface connection area 154 may be modified to receiver other types of interfaces. Contemplated memory devices include, but are not limited to, SD memory cards, MultiMedia Cards, XD picture cards, Memory stick, and other types of devices which may or may not incorporate a USB.

Figure 7:
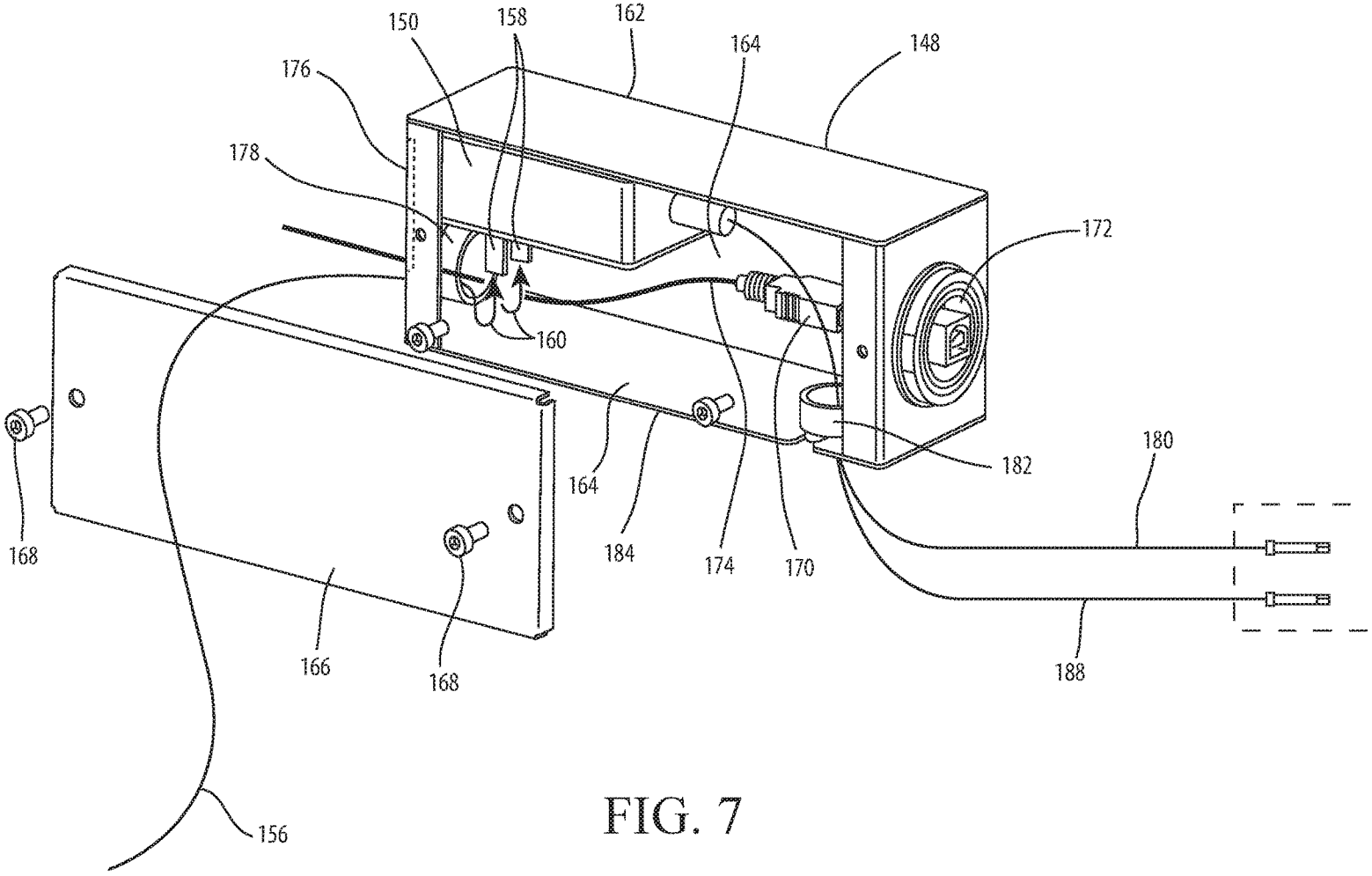
FIG. 7 is a perspective view of a transformer junction box used in an electrical system for the visual display unit.

As shown in FIG. 7, the power junction box 148 is configured to house the transformer 150, which supplies power to the display unit 90. A power wiring harness 156 will enter from an incoming power area, such as a standard electrical outlet. The power wiring harness 156 is configured to enter and couple with connection points 158. Coupling of the wiring harness 156 with the connection points 158 is shown schematically in FIG. 7 by arrows 160. The other end of the harness will run through a channel or conduit within the door assembly 40.

In the configuration shown in FIG. 7, the power junction box 148 includes a housing 162 defining an opening 164 for a junction box cover 166. Fasteners 168 are used to couple the cover to the housing 162. A media connector 170 is positioned within the housing through a sidewall opening 172. Connected to the media connector is connector cable 174. This wire is configured for placement through an opposite sidewall opening 176 and a bushing 178. Coupled to the transformer 150 is transformer cable 180, which is adapted to travel through a front wall bushing 182 that is coupled to the bottom wall 184 of the housing 162. Preferably, adhesive tape is used to facilitate positioning of the junction box 148 within the laundering system 10. The interface junction box 152 (FIG. 2) has a similar configuration as that of the box 148; however the transformer is not included.

The interface wiring harness 138 is configured as a low voltage harness that travels from the transformer 150 to enter the door assembly. The door assembly is further provided with a sectioned area (FIG. 6). that allows the display wiring to channel through the door and connect to the display unit.

Optionally, a connection wiring harness may be used to facilitate data communication. This harness may also be configured for connection to the display unit. In one embodiment, the harness channels through the hatch door to terminate at another media connection area, which is positioned for user access, allowing for a user upload media content. This connection area may also be configured to receive multiple types of memory devices.

Testing Methods

Tables 1-4 provide testing data for a laundering system that includes a display unit assembled with a hatch door. In this testing, two thermocouples were positioned between outer and inner panes, with a first thermocouple (TC 1) being positioned in an area (A) for measurement of the atmospheric temperature directly above the display unit and a second thermocouple (TC 2) being positioned in an area (D) against the backside of the display unit. A weather station was also placed within the chamber of the dryer to measure humidity. Additional measuring devices were used to monitor barometric pressure and temperature within the chamber and the room temperature and relative room humidity.

An 8-inch display unit, manufactured by Toshiba Corporation, as Model Number DMF82xku, was used. The maximum allowable atmospheric temperature for the display unit was specified as 95 degrees Fahrenheit (35° C.). The display unit was installed in a hatch door incorporated within American Dryer Model Number ESG 35/35. The display unit was operated under three different operating conditions: (1) only display unit operating; empty load; (2) display unit and dryer operating, empty load; (3) display unit and dryer operating, full wet load. The following results were recorded:

TABLE 1

| Operating Condition (1) | | | |
|---|---|---|---|
| Start Time | 3:00 PM | Finish Time | 8:00 AM |
| Start Temperature | 80° F. | Finish Temperature | 77° F. |
| Start Humidity | 44% | Finish Humidity | 66% |
| Start Barometric Pressure | 29.83 | Finish Barometric Pressure | 29.74 |
| TC 1 Start Temperature (A) | 81.1° F. | TC 1 Finish Temperature (A) | 85.5° F. |
| TC 2 Start Temperature (D) | 82.3° F. | TC 2 Finish Temperature (D) | 100.6° F. |

TABLE 2

| Operating Condition (1) | | | |
|---|---|---|---|
| Start Time | 8:00 AM | Finish Time | 4:00 PM |
| Start Temperature | 77° F. | Finish Temperature | 85° F. |
| Start Humidity | 66% | Finish Humidity | 70% |
| Start Barometric Pressure | 29.74 | Finish Barometric Pressure | 29.7 |
| TC 1 Start Temperature (A) | 85.5° F. | TC 1 Finish Temperature (A) | 91.1° F. |

TABLE 2-continued

| Operating Condition (1) | | | |
|---|---|---|---|
| TC 2 Start Temperature (D) | 100.6° F. | TC 2 Finish Temperature (D) | 105.8° F. |

TABLE 3

| Operating Condition (2) | | | |
|---|---|---|---|
| Start Time | 10 AM | Finish Time | 11 AM |
| Start Temperature | 79° F. | Finish Temperature | 85° F. |
| Start Humidity | 72% | Finish Humidity | 70% |
| Start Barometric Pressure | 29.59 | Finish Barometric Pressure | 29.7 |
| TC 1 Start Temperature (A) | 91.1° F. | TC 1 Final Temperature (A) | 93.2° F. |
| TC 2 Start Temperature (D) | 105.8° F. | TC 2 Final Temperature (D) | 131.6° F. |

TABLE 4

| Operating Condition (3) | | | |
|---|---|---|---|
| Start Time | 12 PM | Finish Time | 1:30 PM |
| Start Temperature | 80° F. | Finish Temperature | 83° F. |
| Start Humidity | 69% | Finish Humidity | 64% |
| Start Barometric Pressure | 29.59 | Finish Barometric Pressure | 29.59 |
| TC 1 Start Temperature (A) | 92.1° F. | TC 1 Final Temperature (A) | 94.8° F. |
| TC 2 Start Temperature (D) | 99.2° F. | TC 2 Final Temperature (D) | 142.2° F. |

As the testing indicates, the measured values of TC 1 are below the maximum temperature limit for atmospheric conditions, as specified by the display unit manufacturer.

While embodiments and testing examples of this invention have been shown and described, nothing in this specification should be considered as limiting. All examples and test data presented are representative and non-limiting. Moreover, the above described embodiments of the invention may be modified or varied, and elements added or omitted, without departing from the invention, as appreciated by persons skilled in the art in light of the above teachings. It is therefore to be understood that the invention is to be measured by the scope of the claims, and may be practiced in alternative manners to those which have been specifically described in the specification without departing from the inventive concepts herein.

What is claimed is:

1. A hatch door (41) configured to close an opening for a chamber of a laundering system (10), comprising:

an outer door skin (46) having an outer opening (47) and an outer pane (50) positioned within the outer opening (47);

an inner door skin (76) positioned a distance away from the outer door skin (46), the inner door skin (76) having an inner opening (87) and an inner pane (78) positioned within the inner opening (87);

a display mount bracket (92) connected to the inner door skin (76), wherein the display mount bracket (92) comprises side restraints (110) each extending across a respective portion of the inner opening and said side restraints positioning a visual display unit (90) centrally with respect to the inner opening (87), wherein the display mount bracket (92) supports the visual display unit (90) within a viewing perimeter of the inner pane (78) such that an interior of the laundering system (10) is visible through the inner pane (78) between the viewing perimeter and a perimeter of the visual display unit (90); and the visual display unit (90) coupled to the inner door skin and supported centrally in the viewing perimeter by the display mount bracket (92), the display mount bracket (92) and the visual display unit (90) being positioned between the outer pane (5) and the inner pane (78), the visual display unit in communication with a media interface, wherein the visual display unit is configured to:

receive video content from the media interface; and display the video content during exposure of the hatch door (41) to laundering-specific operating conditions in the chamber as the laundering system (10) operates.

2. The hatch door (41) according to claim 1, further comprising an electrical system (140) disposed within the hatch door.

3. The hatch door (41) according to claim 2, wherein the electrical system comprises an interface junction box (152) having an interface connection area (154).

4. The hatch door (41) according to claim 2, wherein the electrical system comprises a power junction box (148) that provides power to the visual display unit (90).

5. The hatch door (41) according to claim 1, wherein the display mount bracket (92) further comprises an upper restraint (106) and a lower restraint (108) at least one of which is configured to retain the visual display unit (90).

6. The hatch door (41) according to claim 1, wherein the laundering-specific operating conditions in the chamber include a laundering-specific operating temperature of 93° C.

7. The hatch door (41) according to claim 6, wherein the laundering-specific operating conditions include a laundering-specific operating humidity from 100% to about 20%.

8. The hatch door (41) according to claim 1, further comprising a door pan (82) coupled to the outer pane (50) and the inner pane (78).

9. The hatch door (41) according to claim 1, further comprising a display mount cover (88) fitted over a rear of the display unit (90) adjacent the display mount bracket (92).

10. The hatch door (41) according to claim 9, wherein the display mount cover (88) includes a plurality of venting elements (98).

11. The hatch door (41) according to claim 1, wherein the display mount bracket (92) further comprises at least one cushioning element (111) configured to form a ventilation space between the display mount bracket (92) and the visual display unit (90).

12. The hatch door (41) according to claim 1, wherein each of the outer pane (50) and the inner pane (78) comprise a transparent material.

13. A hatch door (41) for a laundering system (10), comprising:

an outer door skin (46) having an outer opening (47) and an outer pane (50) positioned within the outer opening (47);

an inner door skin (76) positioned a distance away from the outer door skin (46), the inner door skin (76) having an inner opening (87) and an inner pane (78) positioned within the inner opening (87), wherein the inner pane comprises to an at least partially transparent window arranged such that an interior of the laundering system is visible therethrough;

a display mount bracket (92) connected to the inner door skin (76); and a video display unit (90) configured to present video content through the outer pane (50) during exposure of the hatch door (41) to laundering-specific operating conditions as the laundering system (10) operates, the video display unit (90) coupled to the inner door skin and supported by the display mount bracket (92), the display mount bracket (92) and the video display unit (90) being positioned between the outer pane (5) and the inner pane (78), wherein the display mount bracket (92) comprises side restraints extending across respective portions of the inner opening and supporting the video display unit (90) within a viewing perimeter of the inner pane (78) such that the interior of the laundering system (10) is visible through the inner pane (78) between the viewing perimeter and a screen perimeter of the video display unit (90).

14. The hatch door (41) according to claim 13, wherein the laundering-specific operating conditions include a temperature of 70 degrees Fahrenheit (21° C.) to about 200 degrees Fahrenheit (93° C.).

15. The hatch door (41) according to claim 13, further comprising:

a media interface in communication with the video display unit (41).

16. The hatch door (41) according to claim 15, wherein the media interface is configured to access the video content and communicate the video content to the video display unit (90).

* * * * *